United States Patent [19]

Katz

[11] Patent Number: 4,543,669

[45] Date of Patent: Oct. 1, 1985

[54] COMBINATION TOY AND GARMENT

[76] Inventor: Robert F. Katz, 1401 Manzanita St., Manhattan Beach, Calif. 90266

[21] Appl. No.: 593,560

[22] Filed: Mar. 26, 1984

[51] Int. Cl.[4] ..... A41D 10/00

[52] U.S. Cl. ..... 2/84; 446/369

[58] Field of Search ..... 446/369; 2/84, 85, 86, 2/94

[56] References Cited

U.S. PATENT DOCUMENTS 1,702,143 2/1929 Weisz ..... 2/84

2,971,198 2/1961 Tomich ..... 2/84

4,064,562 12/1977 Kenny ..... 2/84

4,404,689 9/1983 DeWan ..... 2/88

*Primary Examiner*—Doris L. Troutman

*Attorney, Agent, or Firm*—Lyon & Lyon

[57] ABSTRACT

A combination toy and garment comprising a toy portion and a garment portion attached together to form an article of clothing such that when the garment portion is enfolded by the toy portion the combination takes the shape of a stuffed toy.

6 Claims, 4 Drawing Figures

COMBINATION TOY AND GARMENT

BACKGROUND OF THE INVENTION

The present invention is in the field of garments. More specifically, the invention is directed to a combination toy and garment, wherein a child's garment may be folded in a manner which transforms the garment into a stuffed toy.

One of the annoying aspects of caring for children is the fact that the adult is generally forced to carry the child's coat, sweatshirt, etc., when the child is not wearing them. The parent is forced to carry the clothing because no method has been found for persuading children to carry their own clothes.

SUMMARY OF THE INVENTION

The present invention pertains to garments fabricated such that a child will want to carry his own garment. This is achieved by the combination toy and garment of the present invention.

The combination toy and garment is comprised of a toy portion and a garment portion attached together such when the garment portion is enfolded by the toy portion the combination toy and garment is in the shape of a stuffed toy that is attractive to a child, such that he will enjoy carrying and playing with it. By unfolding the garment portion, the combination toy and garment becomes an article of clothing such as a sweatshirt or other article of outerwear. Thus, when the child gets cold the combination toy and garment can be worn and when the child gets warm the combination toy and garment can be transformed into a stuffed toy that is carried by the child rather than the parent.

Accordingly, it is an object of the present invention to provide a useful piece of clothing that can easily be transformed into a stuffed toy when the article of clothing is not being worn. Other and further objects and advantages will become obvious hereinafter.

DETAILED DESCRIPTION OF THE PREFERRED EMBODIMENT

Figure 1:
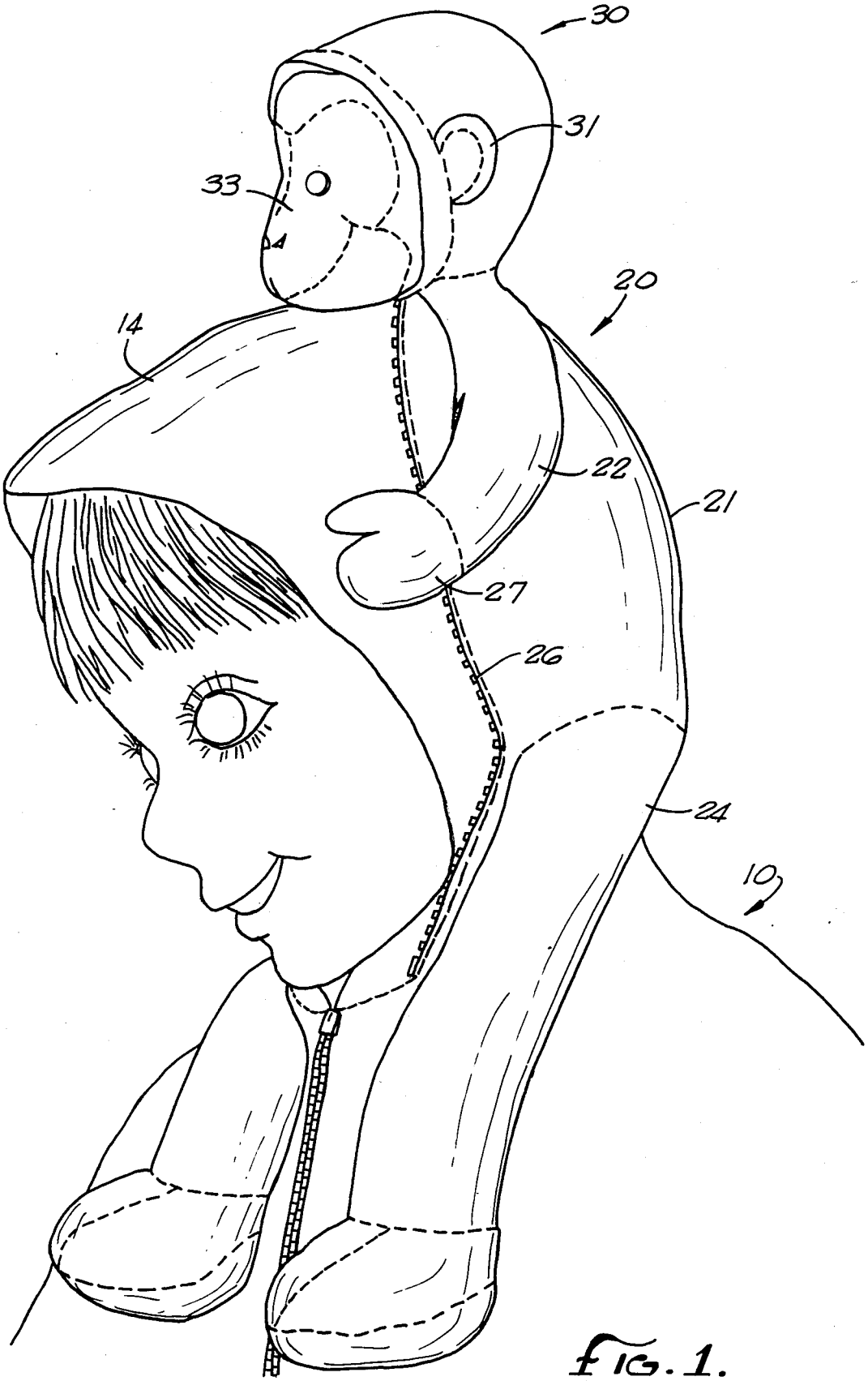
FIG. 1 is a sketch of a child wearing a combination toy and garment of the present invention.
Figure 2:
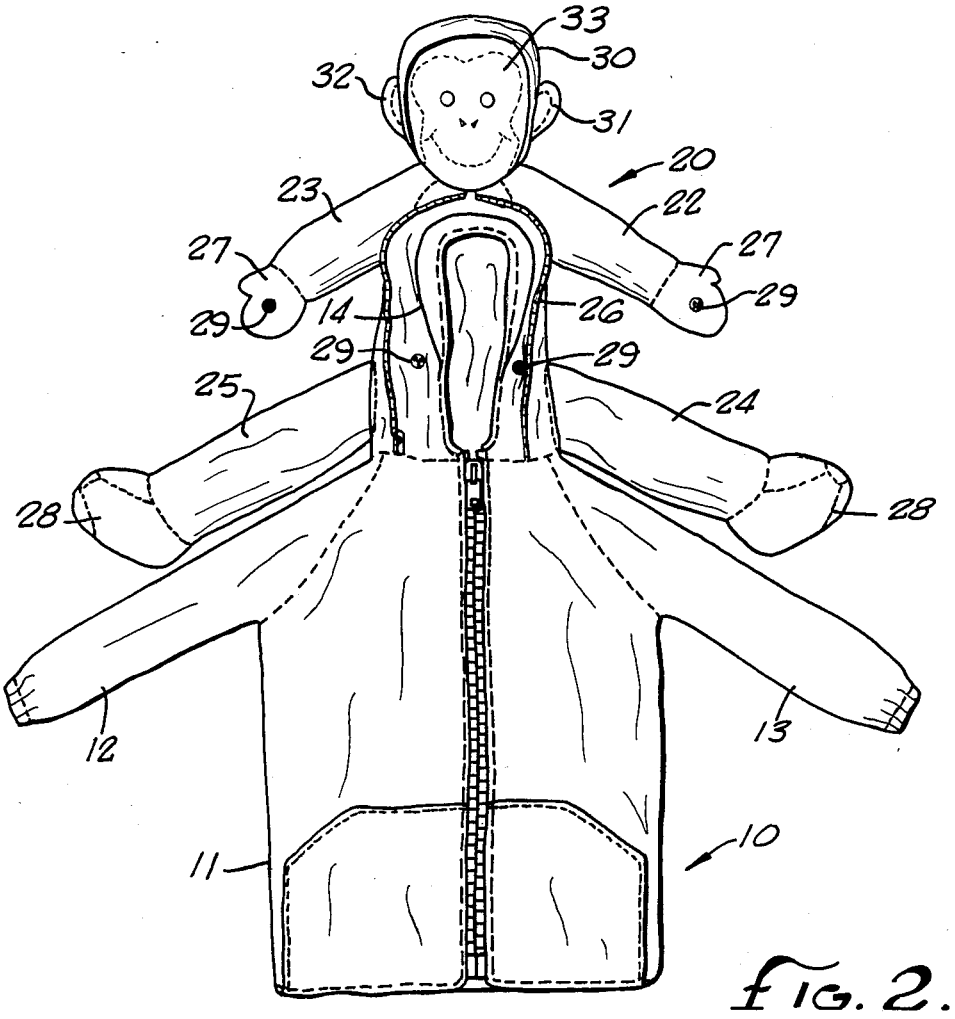
FIG. 2 is a front view of the preferred embodiment of the present invention in the unfolded state.

In FIGS. 1–4 the preferred embodiment of the present invention is shown. The garment portion, generally designated 10, shown best in FIG. 2, is comprised of a body 11, two sleeves 12 and 13 and a hood 14.

The toy portion, generally designated 20, is attached to the garment portion 10 such that an article of clothing is formed. In the preferred embodiment the article of clothing is shown as a hooded sweatshirt but it should be noted that the article of clothing can range from a jumpsuit to a cape and need not necessarily have a hood nor fall within the class of clothing known as outerwear.

The trunk 21 of the toy portion 20 forms the back portion of the hood 14. Arms 22 and 23 and legs 24 and 25 are attached to the trunk 21. The preferred method of attachment is sewing. The arms 22 and 23 and legs 24 and 25 are of tubular construction and stuffed with a soft, pliable material such as is used in stuffed toys.

A head 30 is also attached to the trunk 21, and as with the arms and legs is preferably sewn on and stuffed with a soft, pliable material. Ears 31 and 32 and facial features 33 have been added to the head 30 to make the stuffed toy more attractive to children.

Figure 3:
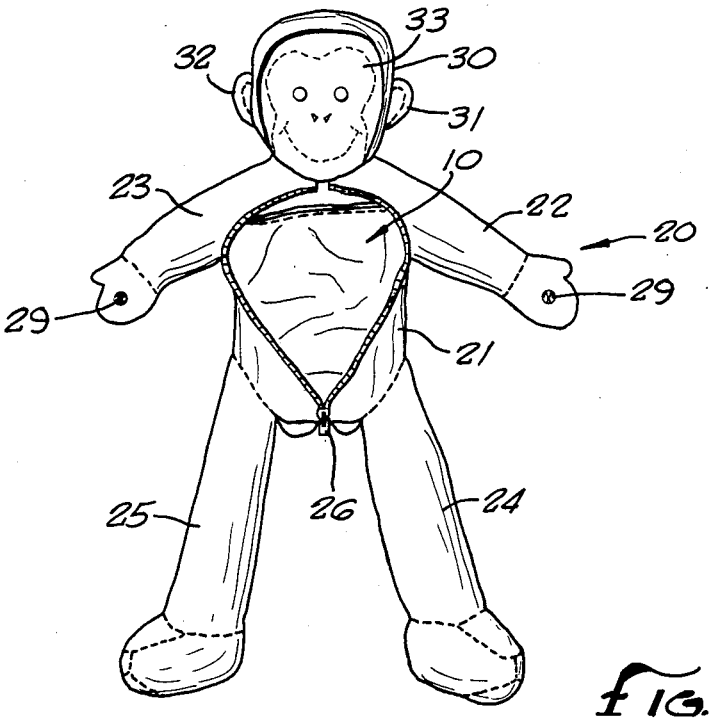
FIG. 3 depicts the preferred embodiment of the present invention in its folded state.
Figure 4:
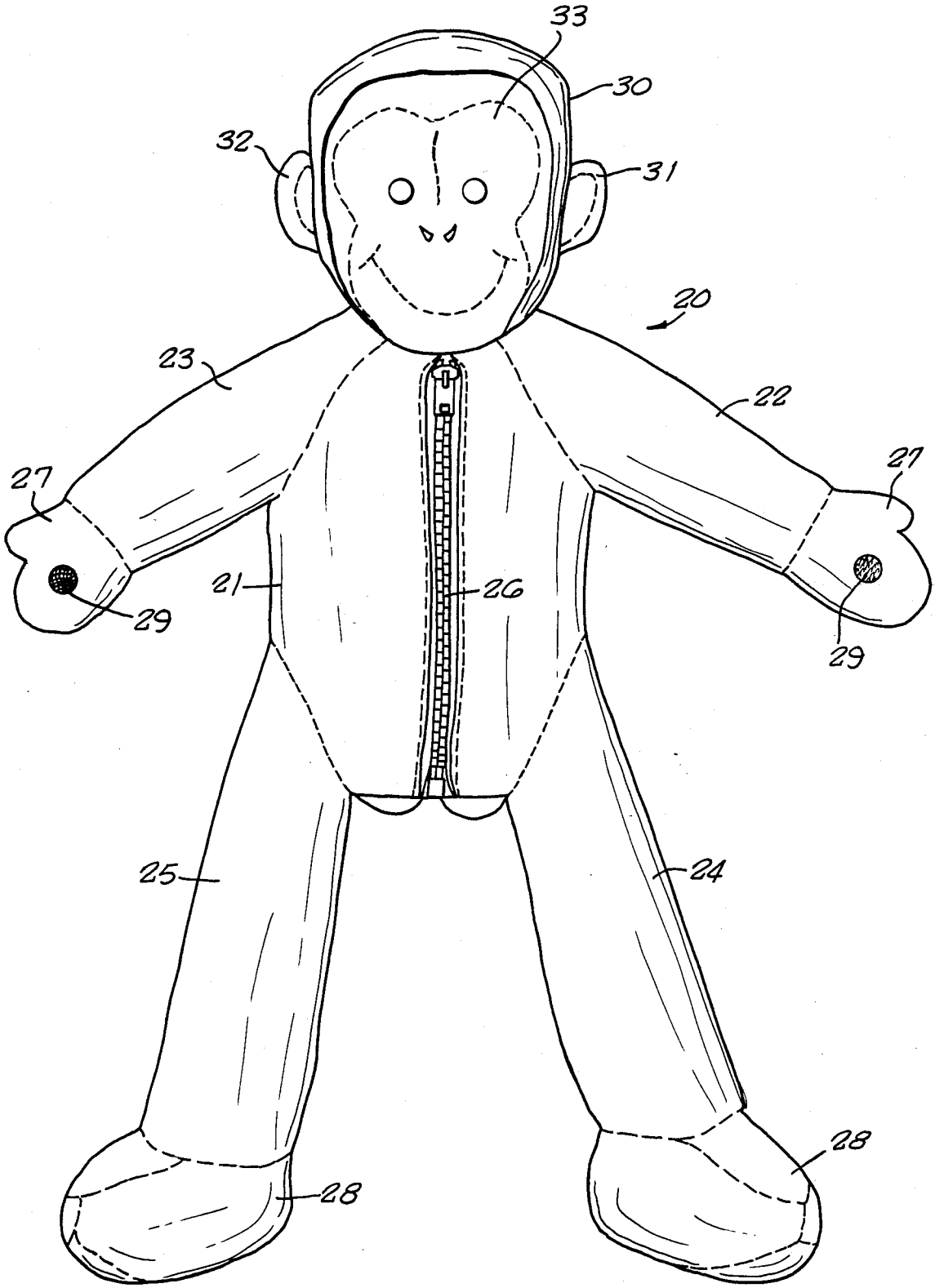
FIG. 4 depicts the preferred embodiment of the present invention in the shape of a stuffed toy.

A fastening means, shown as a zipper 26, is attached to the trunk 21 and forms part of the boundary between the garment portion 10 and the toy portion 20. The fastening means is attached such that when the garment portion 10 is enfolded by the toy portion 20, the fastening means may be engaged, as shown in FIG. 3, such that the combination toy and garment will retain the shape of a stuffed toy as shown in FIG. 4. The fastening means, although shown as a zipper 26, may be any conventional fastener, e.g. buttons, ties, or snaps.

Hands 27 and feet 28 are attached to the arms 22 and 23 and the legs 24 and 25. Securing means, such as Velcro TM fasteners 29, are attached to the hands 27 and the hood 14 such that the hands 27, may be attached to the hood 14 when the invention is being worn, as shown in FIG. 1, and such that the hands 27 may be attached together when the invention takes the shape of a stuffed toy.

In practice, once the child has removed the invention, the garment portion 10 is folded into the toy portion 20 such that the garment portion 10 is enfolded by the toy portion 20. In this state the invention has taken the shape of a stuffed toy. This shape is maintained by engaging the fastening means i.e. zipping the zipper 26, allowing the child to play with and carry the invention. When the child goes outside or has a need to wear the invention, the zipper 26 is unzipped and the garment portion unfolded out of the toy portion, transforming the invention into an article of clothing. The parent is thus relieved of the burden of carrying the child's clothing when it is not being worn, while at the same time the child is provided with a toy.

While embodiments and applications of this invention have been shown and described, as would be apparent to those skilled in the art many more modifications are possible without departing from the invention concepts described herein. The invention, therefore, is not to be restricted except in the spirit of the appended claims.

What is claimed is:

1. A combination toy and garment comprising a toy portion and a garment portion attached together to form an article of clothing having a hood; said toy portion comprising a trunk having at least one appendage and at least one head attached to said trunk; said trunk forming a part of said hood such that when said garment portion is enfolded by said toy portion the combination takes the shape of a stuffed doll and when said article of clothing is being worn said head sits on the top of said hood; and said toy portion further comprises a fastening means attached to said trunk such that when said garment portion is enfolded by said toy portion said shape of a stuffed doll is maintained by engaging said fastening means.

2. A combination toy and garment of claim 1 wherein said fastening means comprises a zipper.

3. A combination toy and garment of claim 2 wherein said article of clothing comprises a body and two sleeves.

4. A combination toy and garment comprising a toy portion and a garment portion attached together to form an article of clothing having a hood; said toy portion comprising a trunk, said trunk forming a part of said hood such that when said garment portion is enfolded by said toy portion the combination takes the shape of a stuffed toy; and said toy portion further comprises a fastening means attached to said trunk such that when said garment portion is enfolded by said toy portion said shape of a stuffed toy is maintained by engaging said fastening means, wherein said toy portion further comprises two arms, two legs and a head attached to said trunk such that said shape of a stuffed toy is a doll and when said article of clothing is being worn said head sits on the top of said hood and said legs and said arms hang on either side of said hood.

5. A combination toy and garment of claim 4 wherein said arms comprise hands.

6. A combination toy and garment of claim 5 further comprising a securing means attached to said hood and said hands such that said hands may be removeably secured to each other when the combination is in said shape of a stuffed toy and removeably secured to either side of said hood when said fastening means is not engaged.

* * * * *